US005248062A

United States Patent [19]

Hillard

[11] Patent Number: 5,248,062

[45] Date of Patent: Sep. 28, 1993

[54] BEER KEG TAP APPARATUS

[76] Inventor: Vincent G. Hillard, 147 6th St., Blakely, Pa. 18447

[21] Appl. No.: 858,040

[22] Filed: Mar. 26, 1992

[51] Int. Cl.[5] ..... B67D 5/00

[52] U.S. Cl. ..... 222/81; 222/145; 222/396; 222/399; 239/318

[58] Field of Search ..... 222/80, 81, 145, 396, 222/399, 401; 239/310, 318

[56] References Cited

U.S. PATENT DOCUMENTS 1,935,973 11/1933 Altmann ..... 222/399 X
3,053,422 9/1962 Tenison et al. ..... 222/399
3,269,598 8/1966 Butters et al. ..... 222/399 X
3,272,404 9/1966 Graves et al. ..... 222/399 X
3,883,043 5/1975 Lane ..... 222/399 X
4,475,689 10/1984 Hauger et al. ..... 239/318

*Primary Examiner*—Andres Kashnikow
*Assistant Examiner*—J. A. Kaufman
*Attorney, Agent, or Firm*—Leon Gilden

[57] ABSTRACT

A tap member is arranged with a threaded lid directed into engagement with an upper end of the tap structure configured as a cylindrical housing, including a cavity receiving a compressed gas canister therewithin. Upon projection of the lid into the housing, the canister is pierced directing compressed gas from the canister into an underlying beer keg, whereupon beer is dispensed through a dispensing conduit.

1 Claim, 4 Drawing Sheets

25
10
11
12
14
16
13
39
40

3
25
14

35
39
3

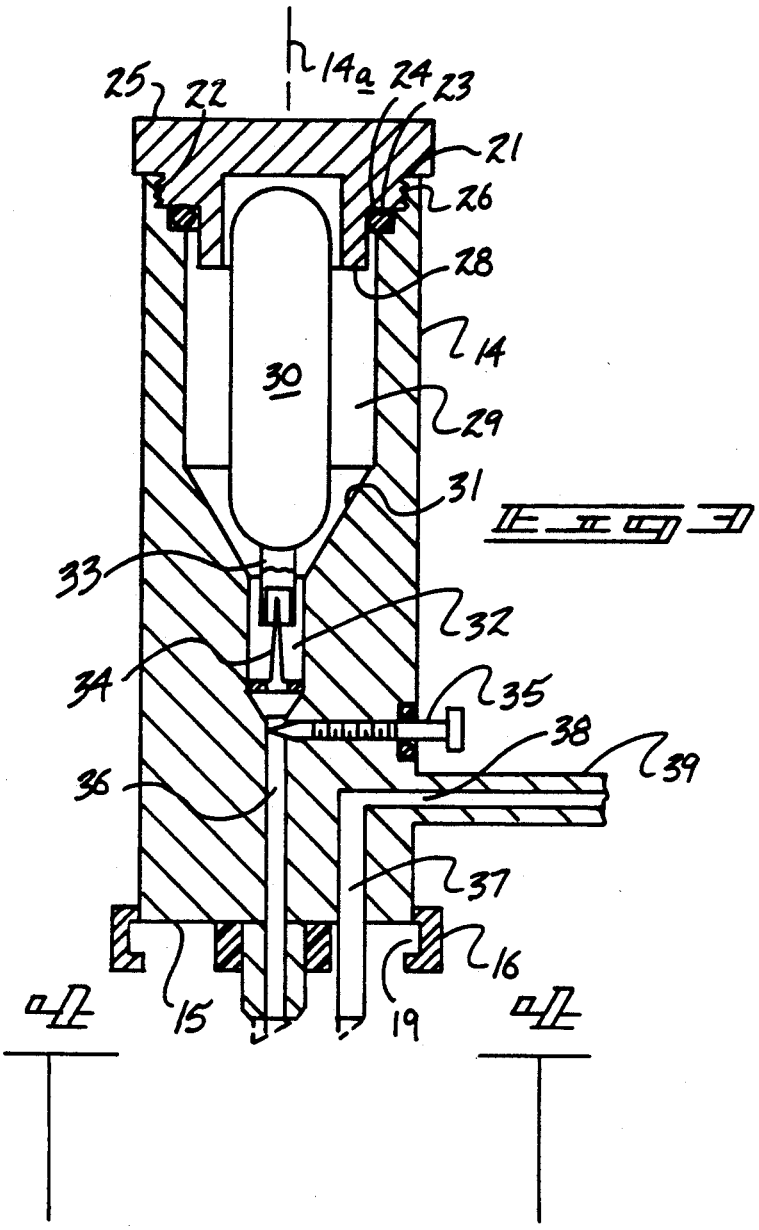
Fig 3
Fig 4
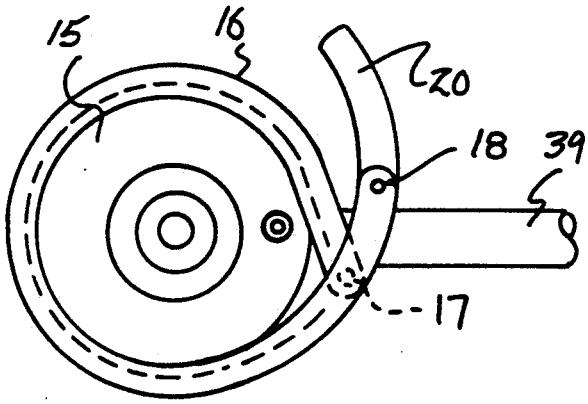

BEER KEG TAP APPARATUS

BACKGROUND OF THE INVENTION

1. Field of the Invention

The field of invention relates to beer dispensing apparatus, and more particularly pertains to a new and improved beer keg tap apparatus wherein the same is arranged for the selective pressurizing and dispensing of beer relative to a beer keg structure.

1. Description of the Prior Art

Typical beer keg dispensing structure employs a housing including a pump member arranged to pressurize a beer keg underlying the pump when the pump structure is mounted to the beer keg. The instant invention attempts to overcome deficiencies of the prior art by utilizing a compressed gas canister arranged for selective puncturing of the canister to project compressed gas into the beer keg for the pressurizing and dispensing of beer from the associated beer keg structure. A beer keg arrangement of typical construction utilized in the prior art is exemplified in the U.S. Pat. No. 4,368,831 with a beer keg tap structure as set forth in the U.S. Pat. No. 4,089,444.

As such, it may be appreciated that there continues to be a need for a new and improved beer keg tap apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of beer keg tap apparatus now present in the prior art, the present invention provides a beer keg tap apparatus wherein the same is arranged for the selective compression of contents of a beer keg and its selective dispensing. As such, the general purpose of the present invention, which will be described subsequently in greater detail, is to provide a new and improved beer keg tap apparatus which has all the advantages of the prior art beer keg tap apparatus and none of the disadvantages.

To attain this, the present invention provides a tap member arranged with a threaded lid directed into engagement with an upper end of the tap structure configured as a cylindrical housing, including a cavity receiving a compressed gas canister therewithin. Upon projection of the lid into the housing, the canister is pierced directing compressed gas from the canister into an underlying beer keg, whereupon beer is dispensed through a dispensing conduit.

My invention resides not in any one of these features per se, but rather in the Particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved beer keg tap apparatus which has all the advantages of the prior art beer keg tap apparatus and none of the disadvantages.

It is another object of the present invention to provide a new and improved beer keg tap apparatus which may be easily and efficiently manufactured and marketed.

It is a further object of the present invention to provide a new and improved beer key tap apparatus which is of a durable and reliable construction.

Still yet another object of the present invention is to provide a new and improved beer keg tap apparatus which provides in the apparatuses and methods of the prior art some of the advantages thereof, while simultaneously overcoming some of the disadvantages normally associated therewith.

These together with other objects of the invention, along with the various features of novelty which characterize the invention, are Pointed out with Particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic view, taken along the lines 3—3 of FIG. 2 in the direction indicated by the arrows.

FIG. 4 is an orthographic view, taken along the lines 4—4 of FIG. 3 in the direction indicated by the arrows.

DESCRIPTION OF THE PREFERRED EMBODIMENT

Figure 1:
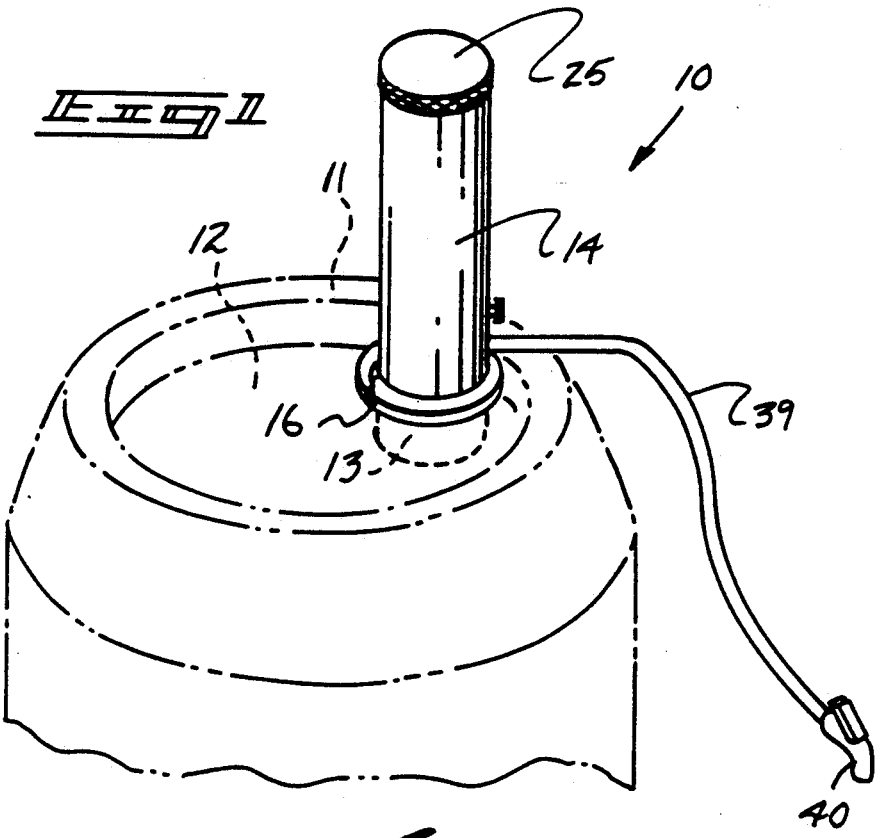
FIG. 1 is an isometric illustration of the invention mounted to a beer keg structure.
Figure 2:
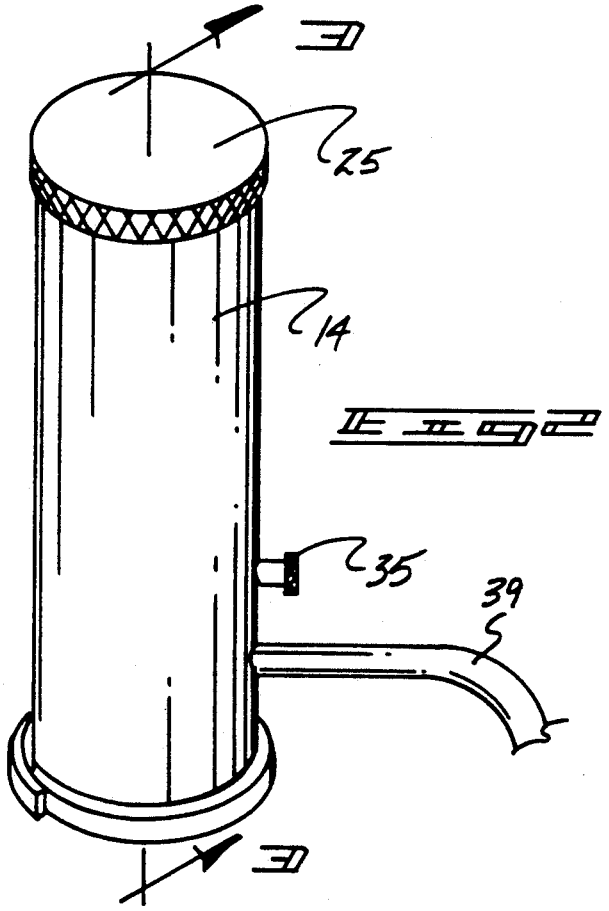
FIG. 2 is an isometric illustration of the instant invention.

With reference now to the drawings, and in particular to FIGS. 1 to 8 thereof, a new and improved beer keg tap apparatus embodying the principles and concepts of the present invention and generally designated by the reference numerals 10, 10*a*, and 10*b* will be described.

More specifically, the beer keg tap apparatus 10 of the instant invention essentially comprises the organization mounted to a beer keg 11, as illustrated in FIG. 1, with the beer keg 11 including a beer keg end wall 12. The end wall 12 includes a cylindrical boss 13 of a type as illustrated in U.S. Pat. No. 4,089,444 incorporated herein by reference. Typically, an annular flange is positioned about the upper distal end of the boss 13.

The invention 10 includes a cylindrical housing 14 of a first diameter, including a housing bottom wall 15. The housing 14 is defined about a housing axis 14*a* (see FIG. 3), with an annular clamping band 16 mounted to a lower distal end of the housing 14 adjacent and in surrounding relationship relative to the bottom wall 15 to include a clamping channel 19 to secure the flange structure of the cylindrical boss 13 of the beer keg. The clamping band includes a first pivot axle 17 and a second pivot axle 18 spaced from the first pivot axle in a parallel relationship, with a clamping band handle 20 extending from the second pivot axle 18 for manual projection of the clamping handle 20 towards the band in the clamping of the band about the cylindrical boss 13.

The housing includes a housing upper end 21 including an upper end internally threaded bore 22 of a second diameter less than the first diameter, with an annular abutment step 23 positioned below the internally threaded bore 23 orthogonally oriented relative to the axis 14*a*. A resilient "O" ring seal 24 is positioned upon the abutment step 23, wherein a housing lid 25 including a lid externally threaded first portion 26 substantially equal to the second diameter is received threadedly in threaded interengagement with the internally threaded bore 22. A lid abutment wall is arranged for engagement with the "O" ring seal 24 to effect a pneumatic and fluid seal relative to the lid and the housing 14. The lid 25 further includes a cylindrical alignment tube 28 fixedly mounted to a bottom surface of the lid for coaxial alignment with the housing axis 14*a* and in coaxial alignment with a housing cavity 29 directed into the cylindrical housing 14 from the housing upper end 21. A compressed gas canister 30 is coaxially aligned within the housing 14 with its upper end received within the cylindrical alignment tube 28. Upon projection and threaded engagement with the lid 25 into the housing, and more specifically with the upper end internally threaded bore 22, the canister 30 and the canister nozzle 33 is directed onto a conduit spike 34 mounted within a housing cavity conical lower end 31. Upon puncturing of the canister 30, compressed gas therefrom is directed from the canister through the housing upper first conduit 32 that is coaxially aligned with the axis 14*a* and in pneumatic communication with the gas canister 30 extending from a lower distal end portion of the conical lower end 31. A pressure control rod 35 orthogonally oriented relative to the axis 14*a* is directed into the housing upper first conduit 32 for selective pressure release of compressed gas from the canister 30 from the housing upper first conduit 32 into a housing lower first conduit 36 in pneumatic communication with the upper first conduit 32. The housing lower first conduit 36 is directed below the housing bottom wall 15 into the beer keg structure. A housing second conduit 37 directed through the bottom wall 15 extends into the housing in pneumatic communication with a housing third conduit 38 that in turn is directed into a flexible dispensing hose 39 that includes a float control nozzle and valve assembly 40 at its outer distal end to selectively permit fluid flow from the beer keg through the flow control nozzle and valve assembly 40.

Figure 5:
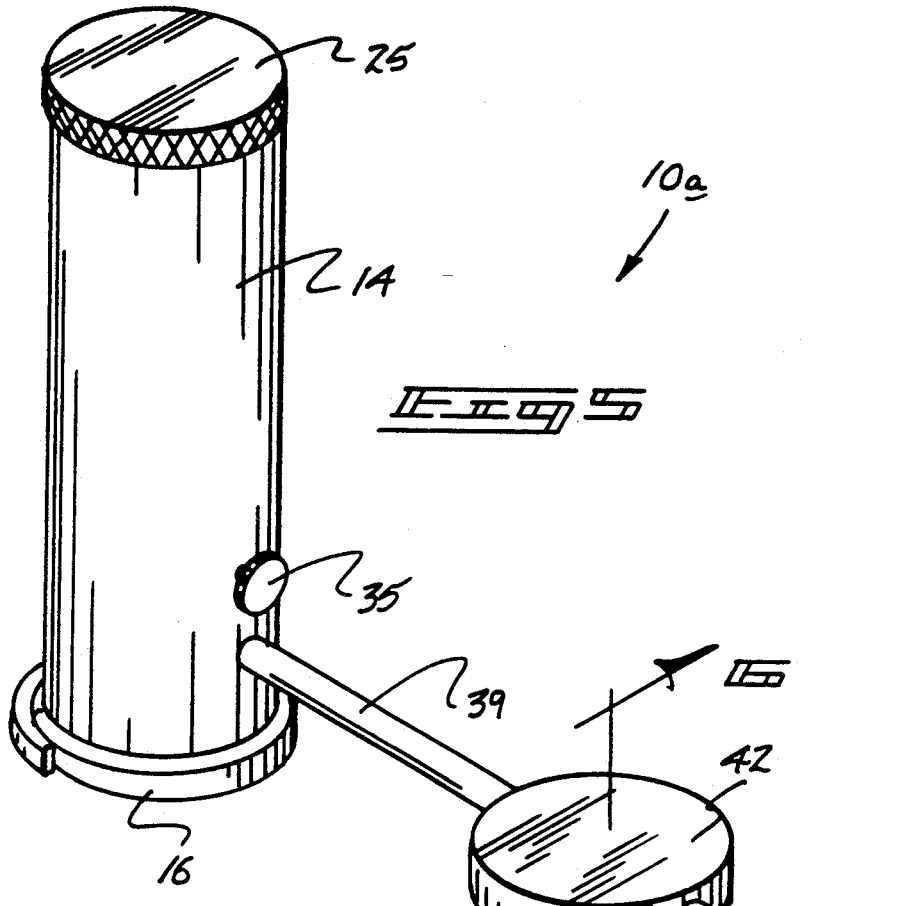
FIG. 5 is an isometric illustration of a modification of the invention.
Figure 6:
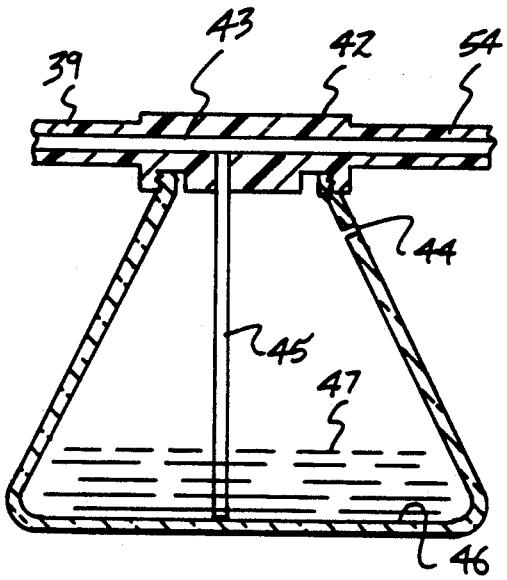
FIG. 6 is an orthographic view, taken along the lines 6—6 of FIG. 5 in the direction indicated by the arrows.

The apparatus 10*a*, as illustrated in the FIG. 5, further includes a mixing container 41 mounted in fluid communication with the flexible hose 39 and the associated third conduit 38 directed through the flexible hose 39. The mixing container 41 includes a mixing container lid 42 selectively securable to an upper distal end and container overlying the container floor 46. The container lid 42 includes a lid conduit 43 directed therethrough in fluid communication with the flexible hose 39. A lid pressurizing conduit 54 directed and extending into the container 41 from the lid conduit 43 extends positioned in adjacency relative to the container floor 46. A metering aperture 44 directed through the container 41 permits relief of contents such as the mixing fluid 47 within the container 41. The mixing fluid 47 may include various fluid such as an alcoholic beverage to be admixed with the mixture within the keg 11 as desired.

Figure 7:
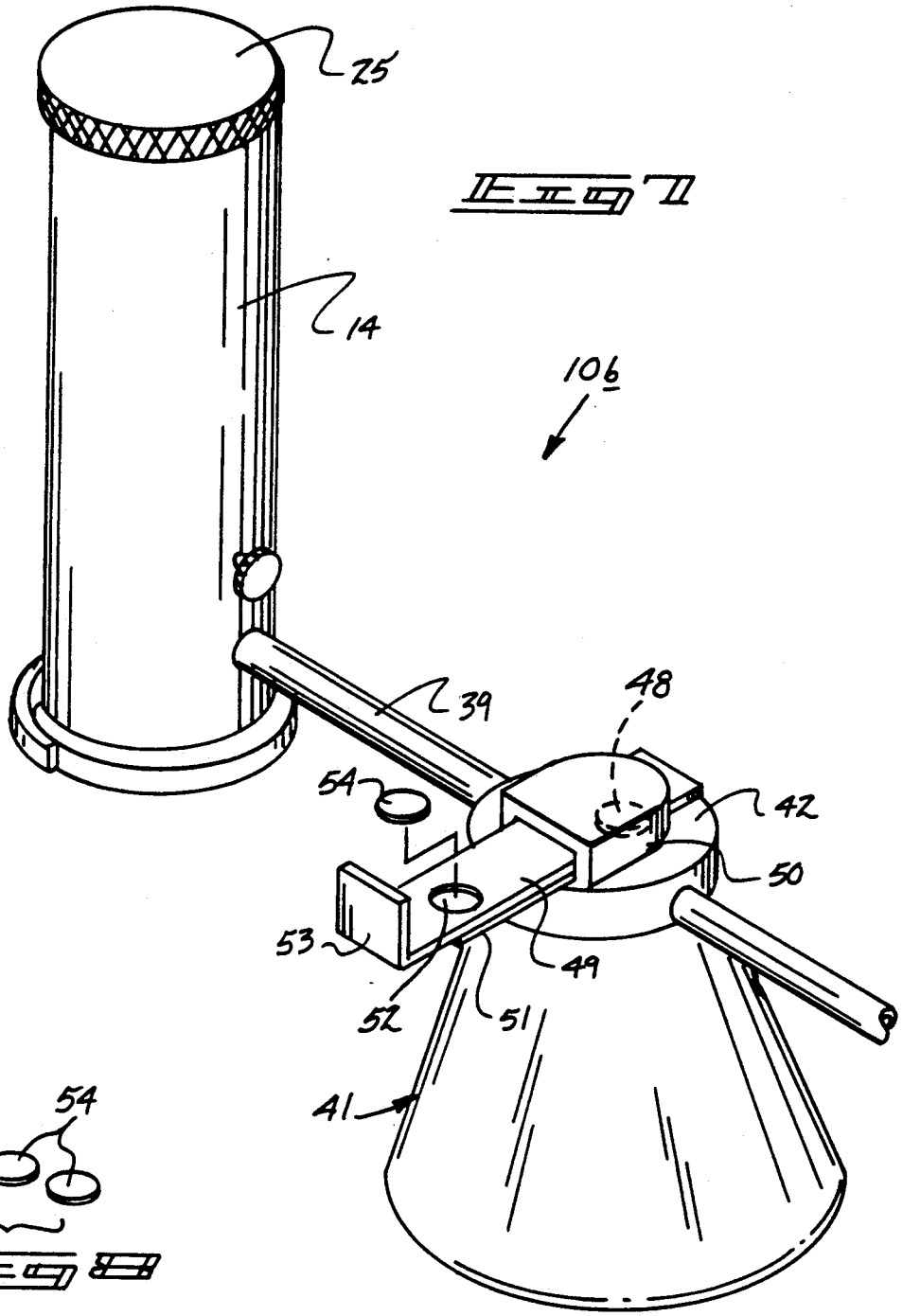
FIG. 7 is an isometric illustration of a further modified aspect of the invention.
Figure 8:
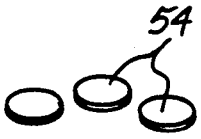
FIG. 8 is an isometric illustration of dye tablets utilized by the invention.

The apparatus 10*b*, as illustrated in the FIG. 7, further includes a lid slide plate 49, including a slide plate opening 52 for receiving a water soluble dye tablet 54 thereon. The slide plate 49 is positioned for sliding and contiguous engagement with a slide plate support flange 51 that in turn is fixedly mounted to the top surface of the lid, with a lid opening 48 arranged for selective coaxially alignment with the slide plate opening 52 upon projection of the slide plate 49 within a slide plate housing 50 that is fixedly mounted to the top surface of the lid 42. Such coloring of beer and the like within the keg 11 is utilized during various holidays, such as St. Patrick's Day, St. Valentine's Day, and the like.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A beer keg tap apparatus arranged for mounting to a beer keg cylindrical boss of a beer keg, wherein the apparatus comprises, a cylindrical housing, the cylindrical housing formed of a first diameter defined about a housing axis, with the housing including a housing bottom wall, and a clamping band mounted about the cylindrical housing in surrounding relationship relative to the bottom wall, and the housing including a housing upper end, the upper end including a housing cavity directed into the housing from the housing upper end, and the upper end including an internally threaded bore of a second diameter less than the first diameter, and a housing lid arranged for reception within the housing upper end, with the housing lid including an externally threaded first portion arranged for securement to the internally threaded bore, and a compressed gas canister arranged for mounting within the housing cavity coaxially aligned about the housing axis, and a housing upper first conduit directed into the housing cavity projecting through the housing floor to effect pressurizing of the beer keg through the cylindrical boss, and an annular abutment step integrally mounted to the housing within the housing cavity positioned below the internally threaded bore, wherein the abutment step is orthogonally oriented relative to the housing axis, and a resilient "O" ring seal positioned upon the abutment step, and the housing lid including a housing lid abutment wall orthogonally oriented relative to the externally threaded first portion for engagement with the "O" ring seal, and a cylindrical alignment tube coaxially aligned relative to the housing lid mounted to a bottom surface thereof, with the alignment tube coaxially aligned with the housing axis when the lid is mounted to the cylindrical housing, and the compressed gas canister arranged for reception within the alignment tube, and the housing cavity includes a housing cavity conical lower end, and the housing cavity conical lower end in pneumatic communication with the housing upper first conduit, and the gas canister including a canister nozzle directed into the housing upper first conduit, and a conduit spike mounted within the housing upper first conduit for reception within the canister nozzle to effect rupture of the gas canister upon projection of the canister nozzle into the conduit spike, and a housing lower first conduit in pneumatic communication with the housing upper first conduit projects below the housing floor, and a housing second conduit projecting below the housing floor spaced from the housing lower first conduit, and a housing third conduit intersecting the housing second conduit in pneumatic communication therewith, wherein the housing third conduit includes a flexible hose projecting from the cylindrical housing, wherein the flexible hose includes a flow control nozzle and valve assembly mounted to a free distal end of the flexible hose, and a mixing container mounted within the flexible hose, the mixing container including a mixing container lid, with the mixing container lid including a lid conduit directed through the mixing container lid in fluid communication with the third conduit, with the third conduit directed through the flexible hose, and a flow conduit in fluid communication with the lid conduit directed into the mixing container, wherein the mixing container includes a mixing container floor, and the flow conduit is directed into the mixing container in adjacency to the container floor, and a vent opening directed through the container, and a slide plate support flange fixedly mounted to the lid to a top surface of the lid, wherein the support flange includes a slide plate housing mounted above the support flange, and a slide plate slidably mounted within the slide plate housing in contiguous communication to a top surface of the support flange, the slide plate including a slide plate opening, wherein the slide plate opening is arranged for coaxial alignment with the lid opening in a second position when the slide plate opening is directed into the slide plate housing from a first position when the slide plate opening is spaced from the slide plate housing, and at least one water soluble dye tablet arranged for mounting within the slide plate opening for projection into the slide plate housing to permit projection of the dye tablet into the container.

* * * * *